US007041926B1

(12) United States Patent
Gadberry

(10) Patent No.: US 7,041,926 B1
(45) Date of Patent: May 9, 2006

(54) METHOD AND SYSTEM FOR SEPARATING AND BLENDING OBJECTS

(76) Inventor: Alan Richard Gadberry, 10547 N. MacArthur Blvd., Apt. 1101, Irving, TX (US) 75063

( * ) Notice: Subject to any disclaimer, the term of this patent is extended or adjusted under 35 U.S.C. 154(b) by 344 days.

(21) Appl. No.: 10/444,211

(22) Filed: May 22, 2003

Related U.S. Application Data

(60) Provisional application No. 60/382,379, filed on May 22, 2002.

(51) Int. Cl.
*B07C 5/342* (2006.01)

(52) U.S. Cl. ..... 209/582; 209/657; 209/658; 209/638; 209/576; 209/577; 209/588

(58) Field of Classification Search ..... 209/657, 209/638, 658, 576, 577, 575
See application file for complete search history.

(56) References Cited

U.S. PATENT DOCUMENTS

| | | | | | |
|---|---|---|---|---|---|
| 3,581,888 | A | * | 6/1971 | Kelly et al. | 209/565 |
| 3,936,188 | A | * | 2/1976 | Sawyer | 356/36 |
| 4,096,949 | A | * | 6/1978 | Hoover et al. | 209/564 |
| 4,231,478 | A | * | 11/1980 | Stone | 209/576 |
| 4,252,240 | A | | 2/1981 | Satake | |
| 4,280,625 | A | * | 7/1981 | Grobbelaar et al. | 209/582 |
| 4,320,841 | A | * | 3/1982 | Gordon et al. | 209/552 |
| 4,630,736 | A | * | 12/1986 | Maughan et al. | 209/587 |
| 4,699,273 | A | | 10/1987 | Suggi-Liverani et al. | |
| 4,951,825 | A | * | 8/1990 | Hawkins et al. | 209/558 |
| 5,184,732 | A | * | 2/1993 | Ditchburn et al. | 209/576 |
| 5,193,685 | A | * | 3/1993 | Trevithick | 209/3.1 |
| 5,333,739 | A | | 8/1994 | Stelte | |
| 5,505,313 | A | * | 4/1996 | Smith et al. | 209/579 |
| 5,533,628 | A | | 7/1996 | Tao | |
| 5,555,984 | A | | 9/1996 | Sommer, Jr. et al. | |
| 5,628,410 | A | * | 5/1997 | Smith et al. | 209/579 |
| 5,794,788 | A | | 8/1998 | Massen | |
| 5,862,919 | A | * | 1/1999 | Eason | 209/577 |
| 6,100,488 | A | | 8/2000 | Satake et al. | |
| 2003/0098978 | A1 | | 5/2003 | Ikeda et al. | |

FOREIGN PATENT DOCUMENTS

DE 3416016 * 11/1985

* cited by examiner

*Primary Examiner*—Donald P. Walsh
*Assistant Examiner*—Jonathan R Miller
(74) *Attorney, Agent, or Firm*—Jack D. Stone, Jr.

(57) ABSTRACT

A method for separating objects, such as stones, wherein each object is dropped through a predefined path, such as a drop tube. Then, for each object, the time when the object passes through a predefined point in the path is determined, as are selected characteristics, such as the color, of the object. The characteristics of the object are matched, if possible, to various criteria and, depending on the criteria to which the object is matched, a diverter gate is activated to divert the object from the predefined path to an appropriate collection bin.

22 Claims, 6 Drawing Sheets

METHOD AND SYSTEM FOR SEPARATING AND BLENDING OBJECTS

CLAIM OF PRIORITY

This application claims priority from U.S. Provisional Patent Application No. 60/382,379 entitled "METHOD AND SYSTEM FOR COLOR SEPARATING AND BLENDING TREE" filed on behalf of Alan Richard Gadberry, on May 22, 2002.

TECHNICAL FIELD

The invention relates generally to a method and system for separating objects based on certain characteristics of the respective objects and, more particularly, to a method and system for separating stones of gravel aggregates by one or more selected characteristics, such as color and/or mineralogy.

BACKGROUND

It is often desirable to obtain objects, such as aggregates of gravel (e.g., stones, rocks, pebbles, gemstones, and the like), for use in decorative concrete for pools, sidewalks, landscaping, and the like. Such gravel aggregates may comprise stones of one or a few colors, or a number of different colors, as desired.

One way to obtain colored stones is to mine it from quarries as crushed aggregate. However, due to the complexities of geology, stones mined from a quarry generally comprises stones of a number of different colors. Thus, to obtain stones of a particular desirable color or number, range, and/or blend of desirable colors, stones of desirable colors mined from a quarry must be separated from stones of undesirable colors and/or multiple colors.

Stones of desirable colors may be separated manually (i.e., by hand) from stones of undesirable colors and/or multiple colors, but such a manual method is very laborious and, as a result, expensive and impractical. Therefore, it is preferable to mine stones of desirable colors from quarries that have a geology yielding a propensity of stones of desirable colors. Locating such a quarry, however, may require traveling great distances and expending substantial sums of monetary resources. It is not uncommon for such quarries to be located hundreds of miles from where such gravel is needed, or even overseas, necessitating the transportation of such gravel over great distances to desired locations.

Even when quarries are located that have a propensity to produce stones of desirable colors, there are often stones of undesirable colors that are mixed in with the stones of desirable colors. Thus, stones of desirable colors must still be separated from stones of undesirable colors.

As mentioned above, stones of desirable color may be separated manually (i.e., by hand) from stones of undesirable color and/or multiple colors by hand. Manual separation, however, is extremely laborious, and thus expensive. For example, a decorative stone facility typically separates and blends more than 10,000 tons of aggregate per year. For half-inch stones, 10,000 tons would require processing about 30 tons of stones per day. At 70 stones per pound, approximately one billion stones would need to be examined and separated each day! This is not economically feasible using manual techniques. Even if such quantity of stones could be feasibly examined and separated manually each day, it would not only be extremely laborious, and thus expensive, but also prone to yield inconsistent results.

In an alternative to quarries, water streams and rivers often provide stones in a collage of different colors. Furthermore, stones found in streams and rivers are also generally mixed, cleaned, and polished and, therefore, generally preferable to stones obtained from quarries. The more varied the geology of an area upstream from a gravel deposit, the more varied the colors of stones found in streams and rivers. The streams and rivers have not only provided a variety of colors but, in many cases, have also transported them closer to decorative aggregate markets, thus reducing transportation costs. However, to obtain stones of particular colors or range of colors, the stones must still be separated. Separation may be accomplished by hand but, as discussed above, manual separation is very laborious, expensive, and prone to inconsistent results.

In an alternative to obtaining stones from select quarries, streams, and/or rivers, and using manual separation techniques, mixtures of stones (or any type of objects or items) of multiple colors may be automatically separated by color using various automated mechanical systems. Such systems that separate stones based on color are, however, binary systems. That is, such systems either accept or reject a stone (or other object) of a certain color from a stream of stones. Such binary systems are, however, not only inadequate to separate the quantity of stones discussed above, but are also inadequate to separate gravel into multiple categories of colors.

Therefore, what is needed is a system and method for efficiently separating large quantities of objects, such as stones, into multiple categories of colors, or other characteristics, such as shape, mineralogy, reflectivity, angle of refraction, radioactivity, and the like.

SUMMARY

The present invention, accordingly, provides a method for separating objects, such as stones, wherein each object is dropped through a predefined path, such as a drop tube. Then, for each object, the time when the object passes through a predefined point in the path is determined, as are selected characteristics, such as the color and/or mineralogy, of the object. The characteristics of the object are matched, if possible, to various criteria and, depending on the criteria to which the object is matched, a diverter gate is activated to divert the object from the predefined path to an appropriate collection bin.

A system according to the present invention includes a feeder for supplying objects to be separated and dropped through a predefined substantially vertical path. A sensor is positioned proximate to the feeder for determining when an object passes through a predefined point in the predefined path, and for determining selected characteristics of the object, and the sensor transmits to a data processor the time when the object passes through a predefined point and the selected characteristics of the object. Program code executable by the processor is configured for determining whether the characteristics of the object match any criteria desired for the object. Diverter gates are positioned along the path of the object and, upon receipt of a signal from the data processor, the diverter is activated to divert the object from the predefined path to a collection bin associated with the object.

The present invention provides for a number of advantages over conventional methods for separating object, such as stone. For example, large quantities of stones, of virtually any size, may be quickly and efficiently separated into any number of categories using virtually any of a number of different criteria, such as color, mineralogy, shape, surface texture, radioactivity, reflectivity, and/or angle of refraction. Different categories of stones may also be automatically and accurately blended together. The present invention also virtually eliminates the need for manual labor and, as a further result, saves much expense and results in much more consistent separation of objects than is possible using manual labor.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning stones, optical recognition, and the like have been omitted inasmuch as such details are not considered necessary to obtain a complete understanding of the present invention, and are considered to be within the skills of persons of ordinary skill in the relevant art.

It is noted that, unless indicated otherwise, all functions described herein are performed by a processor such as a microprocessor, a microcontroller, an application-specific integrated circuit (ASIC), an electronic data processor, a computer, a programmable logic controller, or the like, in accordance with code, such as program code, software, integrated circuits, and/or the like that are coded to perform such functions. Furthermore, it is considered that the design, development, and implementation details of all such code would be apparent to a person having ordinary skill in the art based upon a review of the present description of the invention.

Figure 1:
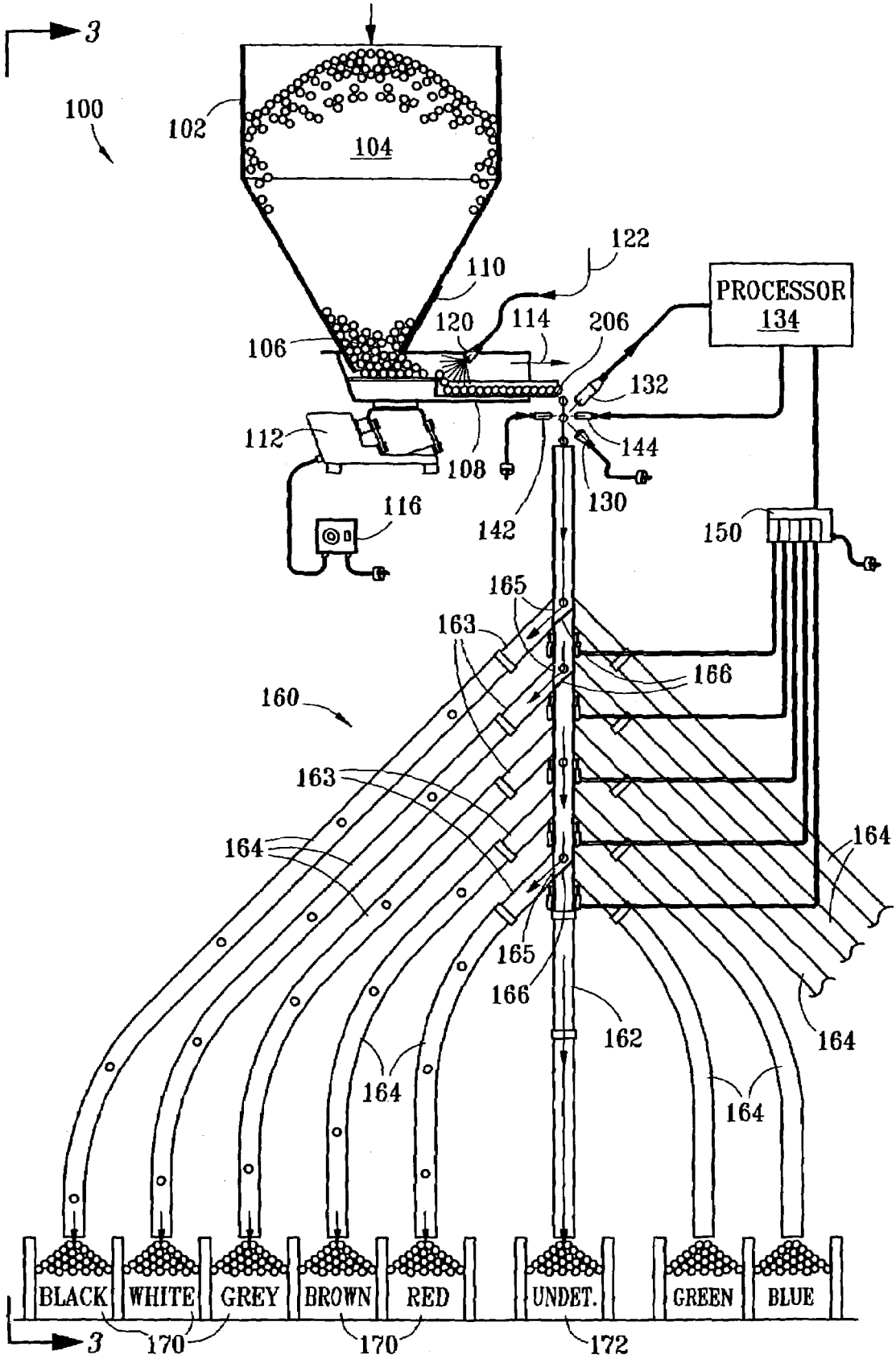
FIG. 1 is an elevation schematic view of a gravel separation system embodying features of the present invention.

Referring to FIG. 1 of the drawings, the reference numeral 100 generally designates system embodying features of the present invention for separating objects, such as gravel comprising a plurality of stones. The system 100 includes a hopper, or surge bin, 102 configured for receiving and holding multi-colored aggregates of gravel 104, referred to herein in the singular as a stone 104 or a stone of gravel 104. A lower end 106 of the bin 102 forms a funnel which is open-ended over a feeder 108. A flow regulator gate 110 is preferably positioned on the lower end 106 of the bin 102 effective for selectably controlling the rate at which gravel passes from the bin 102 to the feeder 108. The feeder 108 comprises substantially a relatively flat plate which is preferably horizontal, but may, optionally, be slightly inclined away from the bin 102 to facilitate a gravity-induced flow of gravel 104 away from the bin 102.

Figure 2:
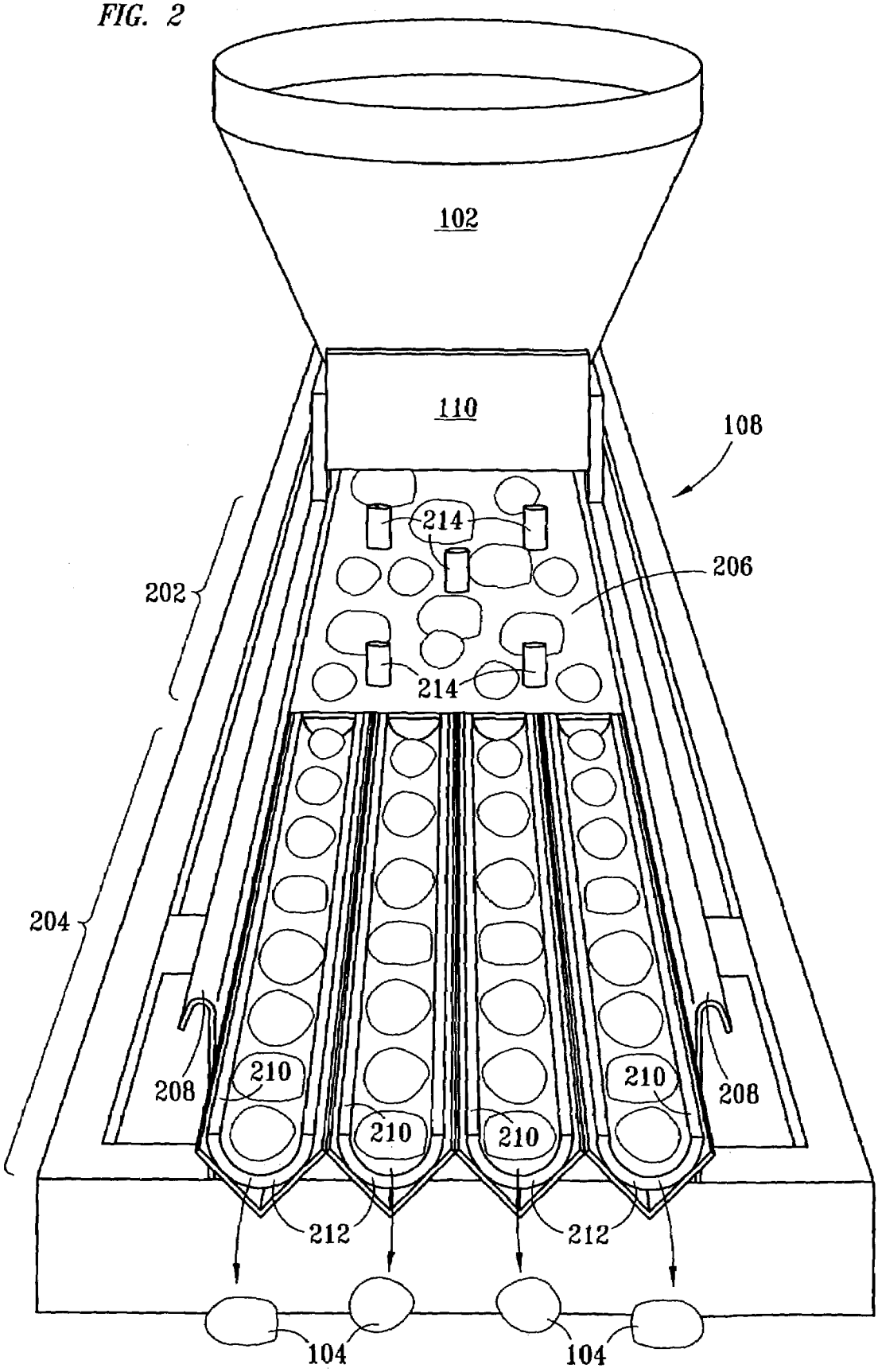
FIG. 2 is a perspective view of a feeder used in conjunction with the embodiment of FIG. 1.
Figure 3:
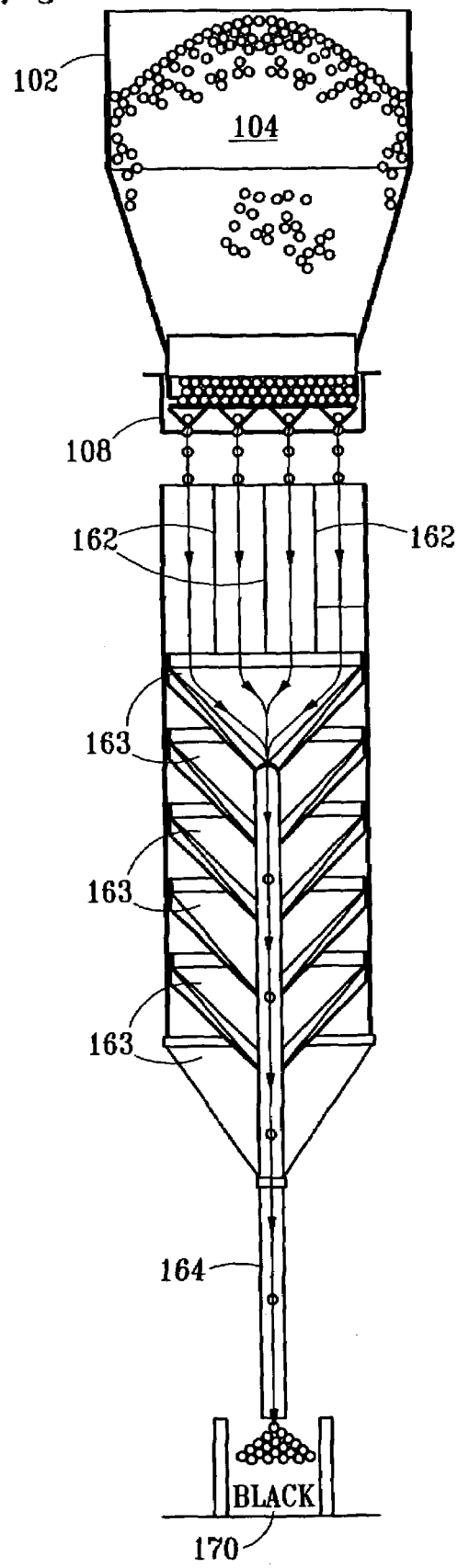
FIG. 3 is an elevation schematic view of the embodiment of FIG. 1 as viewed pursuant to lines 3—3 of FIG. 1.

As shown in FIG. 2, the feeder 108 comprises a first portion 202 and a second portion 204, wherein each portion is preferably of approximately the same length. The first portion 202 comprises the relatively flat plate mentioned above, designated by the reference numeral 206. The plate 206 includes walls 208 on opposing side of the feeder 108, and both the plate 206 and walls 208 preferably extend along the full length of the feeder 108 from the first portion 202 to the second portion 204. The second portion 204 further includes one or more channels 210 (four of which are exemplified in FIG. 2) disposed on the plate 206, which channels further define a lip, or edge, 212 over which gravel falls. The channels 210 are, furthermore, preferably sized for aligning stones of gravel 104 in a single file before they fall, so that stones pass over the edge 212 of each channel 210 only one at a time.

One or more pegs, blocks, or posts, 214 are positioned in the first half 202 of the feeder 108 for controlling and directing the flow of the gravel 104 from the bin 102 to the channels 210, to thereby facilitate to the extent possible a substantially evenly distributed and continuous flow of stones to each channel 210. The specific number and position of the posts 214 may vary depending on a number of factors, such as, by way of example, the size, shape, and weight of the gravel 104, and how readily the gravel 104 moves or is moved about on the feeder 108, which factors may be determined empirically. To facilitate the ready movement of the posts 214 from one or more points on the feeder plate 206 to one or more other points on the feeder plate 206 so that the empirical determination of such factors may be made, the feeder plate 206 is preferably fabricated from a metallic material responsive to magnetic fields, and the posts 214 are preferably provided with magnets (not shown) for securing the posts 214 onto the feeder plate 206. Once the positions of the posts 214 are established, then the positions may be secured more permanently to the feeder plate 206 by using conventional means, such as screws, or nuts and bolts, and/or the like.

Referring back to FIG. 1, a vibrating pan 112 is preferably positioned relative to the feeder 108 for inducing vibration to the feeder 108 to thereby induce movement of the gravel 104 along the feeder 108 in a direction designated schematically by an arrow 114. The vibrating pan 112 is provided with a speed controller 116 for controlling the vibration generated and induced to the feeder 108.

A fluid mist sprayer 120 may optionally be connected for receiving fluid from a fluid source 122, and is positioned above the feeder 108 for spraying a fluid, such as water, wetting agents, a chemical marker (e.g., a dye), di-polar chemicals, and/or the like, received from the fluid source 122 onto the gravel 104 as it passes via the feeder 108 under the sprayer, for enhancing reflection or refraction of light from or through the gravel, altering the color of the gravel in response to a certain characteristic, for bringing out characteristics of the gravel that may otherwise not appear, for controlling dust, to better enable the system 100 to delineate the color and mineralogy of stones of gravel 104, and thereby discriminate one stone from other stones.

An illumination source 130 and an optical color sensor 132, responsive to reflection and/or refraction from stones of the gravel 104 of illumination generated from the illumination source 130, are positioned proximate to the edge 212 of the feeder 108. Specifically, the illumination source 130 is positioned so that the illumination it provides is adequately reflected and/or refracted from a stone 104 to the optical sensor 132, as the stone falls over the edge 212 of the feeder 108, to enable the sensor 132 to detect characteristics, such as the color and mineralogy, of a respective stone. Accordingly, the angle of reflection off of stones, falling between the illumination source 130 and the optical sensor 132, is generally less than about 90°, and preferably less than about 45°. The angle of refraction between the illumination source 130 and the optical sensor 132 of illumination being refracted through a falling stone is generally greater than about 90°, and preferably about 180°. By way of example, such illumination may be achieved by using three illumination sources 130 (only one of which sources is depicted in FIG. 1), wherein one source 130 is positioned about 45° above the sensor 132, a second source 130 is positioned about 45° below the sensor 132, and a third source 130 is positioned behind the stone, preferably about 180° relative to the sensor 132. The illumination source 130 may comprise any of a number of different types of sources effective for generating illumination, such as light from a conventional incandescent light bulb, fluorescent light, neon light, halogen light, infra-red (IR) light, ultra-violet (UV) light, X-ray, laser, microwaves, other types of radiation, and/or the like, which may be reflected from and/or refracted through stones, to thereby facilitate the determination of certain characteristics of stones, such as the color, shape, opacity, surface texture, mineralogy, radioactivity, reflectivity, angle of refraction of a stone, and the like, and combinations thereof. It may be appreciated that, by spraying the gravel 104 with fluid from the sprayer 120, light from the illumination source 130 may be more readily and accurately reflected and/or refracted to the sensor 132, thereby facilitating the delineation of color and mineralogy of a stone.

The optical color sensor 132 is positioned for receiving illumination generated by the illumination source 130 and reflected off of each individual stone of the gravel 104 that falls over the edge 212 of the feeder 108, and for generating at least one signal indicative of one or more characteristics, such as the color value, of each such stone. The sensor 132 is, furthermore, preferably a high-speed area scan camera, such as a digital camera, or alternatively a line scan camera, or other such imaging device, effective for measuring at relatively high speeds illumination (e.g., primary colors) reflected and/or refracted from a stone. The sensor 132 is operatively connected to a processor 134, having memory (not shown) and provided with program code for converting illumination measured by the sensor 132 to numeric values (e.g., 1–256, though other ranges of values may be used), which represent, by way of example, each of the three primary colors (e.g., red, green, and blue, or other color schemes) representing and defining the stone.

The system 100 further includes an illumination source 142 and a synchronizer sensor 144 responsive to the illumination source 142. The synchronizer sensor 144 is positioned opposite the illumination source 142 for receiving a beam of light (e.g., a laser) generated from the illumination source 142. The synchronizer sensor 144 is positioned to generate a beam of light that passes across the path through which a stone of gravel 104 falls, the path being at a level at or above the level at which illumination from the illumination source 130 is reflected off of, or refracted through, a stone of gravel to the illumination sensor 132. The synchronizer 140 is operatively connected to the processor 134 and computer 138 for generating to the processor 134 a signal indicating when the beam of light from the synchronizer illuminator 142 is broken, or interrupted, to thereby indicate that a stone of gravel is in position, or will be in position after a predetermined lapse of time, to permit the sensor 132 to capture an image of the stone and, after a further predetermined lapse of time, as discussed further below, will be in position to be diverted to a bin containing a selected color of stones.

The system 100 still further includes a separation manifold tree 160 comprising a drop tube 162, preferably configured with a substantially square cross-section, through which stones of gravel 104 pass after falling over the edge 212 of the feeder 108. A manifold tree 160 is provided for, and corresponds to, each channel 210 of the feeder 108. The drop tube 162 of each separation manifold tree 160 defines a number of gated openings 165 (described in further detail below), preferably on both of two opposing sides of the drop tube 162, but alternatively from only a single side of the drop tube 162. For the purpose of description herein, the gated openings 165 may be considered to be arranged in arrays which extend across all drop tubes 162, wherein each array consists of one gated opening 165 from each drop tube 162, and each gated opening 165 in a respective array preferably corresponds with respect to position on the tube 162 and separation criteria (e.g., stone color and/or mineralogy) to each other gated opening 165 constituting the respective array. A funnel, or manifold, 163 is preferably provided for each array of gated openings 165, and each manifold 163 is connected for effectuating communication of the manifold with all drop tubes via the gated openings 165 constituting a respective array of gated openings 165. A distribution hose 164 is connected to the manifold 163 at an end of the manifold opposing the gated openings 165 so that objects (e.g., stones) of similar criteria (e.g., color and/or mineralogy) may be passed from each drop tube 162 through a respective gated opening 165 and funneled into a respective distribution hose 164. The distribution hoses 164 extend downwardly from respective manifolds 163 to certain collection bins 170 and 172, which bins 170 receive stones of certain criteria (e.g., color and/or mineralogy), and the bin 172 receives stones that do not meet the criteria (e.g., undetermined colors), as described further below.

Figure 4:
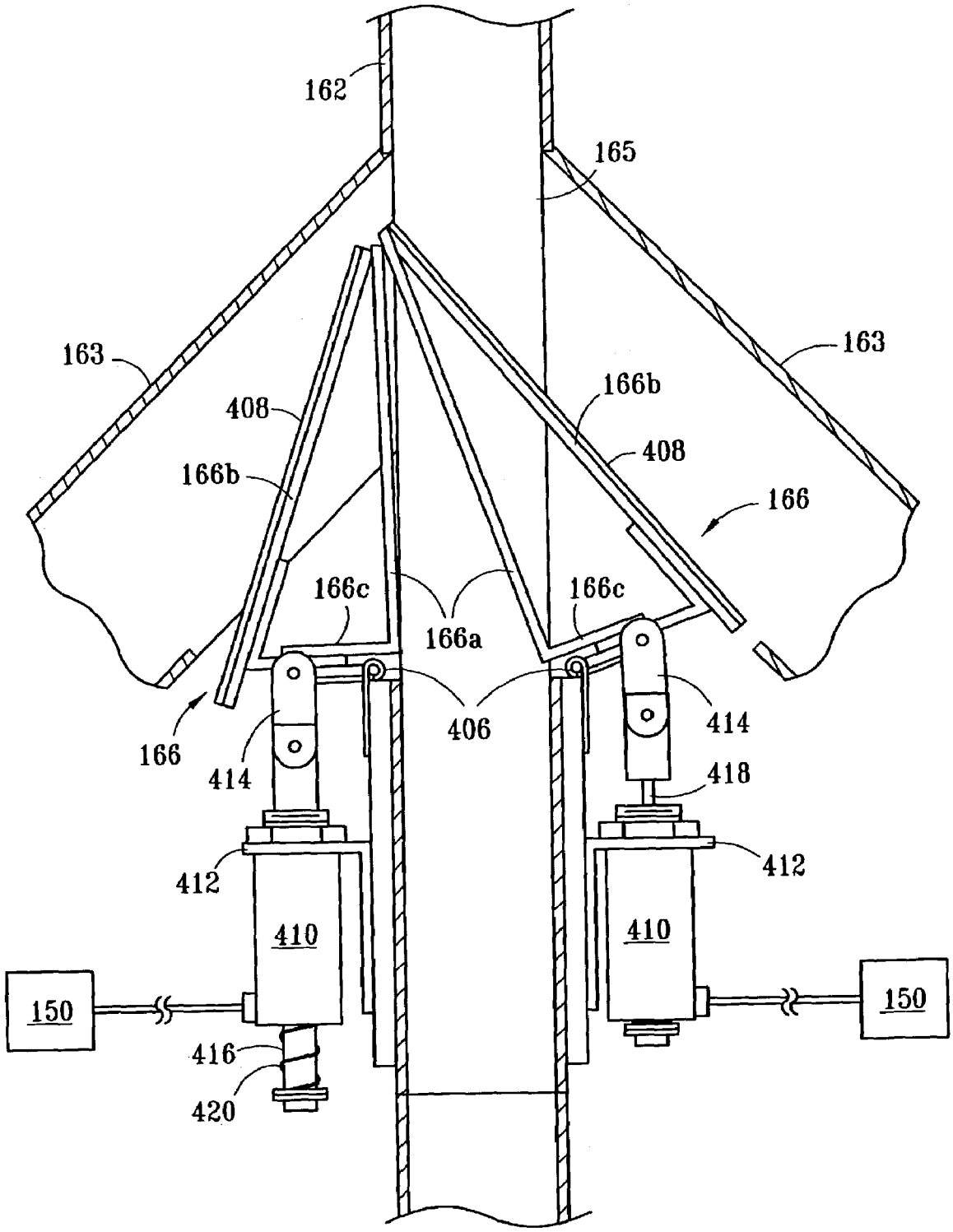
FIG. 4 is an elevation, cross-sectional view of a portion of a manifold tree showing two diverter gates of the embodiment of FIG. 1.

FIG. 4 depicts a cross-section of the drop tube 162 and manifold 163 at two opposing gated openings 165, designated by the reference numeral 165. A diverter gate 166 is pivotally secured to the drop tube 162 via a pivot mechanism 406, such as a hinge, for selectively opening or closing the opening 165. The diverter gate 166 preferably comprises a triangular shape having a vertical portion 166*a*, a horizontal portion 166*b*, and an angled diverter portion 166*c*, all portions of which are fabricated from any suitable conventional material, such as metal, plastic, a composite, or the like. A wear plate 408, fabricated from a high-wear-resistant material, such as a high-density plastic, nylon, or the like, is removably secured to the surface of the diverter portion 166*c*. A solenoid 410 is attached to the tube 162 via a support bracket 412, and is pivotally connected via a linkage 414 to the horizontal portion 166*b* of the gate 166. The solenoid 410 comprises a piston, or plunger, 416 and rod 418 extending from the plunger 410. A spring 420 is preferably positioned on a lower end of the piston 410 for biasing the piston 410 downwardly, thereby biasing the gate 166 in a closed position. Alternatively, or additionally, a spring may be positioned at any suitable location (e.g., on the hinge) for biasing the gate 166 in a closed position.

A solenoid controller 150 is electrically connected to each of the solenoids 410 and to the processor 134 for receiving from the processor 134 a signal indicating when and for what prescribed period of time a particular solenoid 410 is to be activated. In response to such a signal received from the processor 134, the solenoid controller 150 directs electrical power at the indicated time to activate the particular solenoid, to thereby open a particular gate 166 for the prescribed period of time.

In the operation of the present invention as described hereinabove with respect to FIGS. 1–4, the processor 134 is, preferably, first "trained" to recognize and categorize stones based on certain pre-defined criteria (e.g., color, mineralogy, shape, texture, opacity, and/or the like), that define one or more categories of stones delineated by certain characteristics (e.g., reflectivity, angle of refraction, radioactivity, and/or the like, detected by the sensor 132) and/or combinations of such characteristics desired in such stones. The predefined criteria are preferably entered into a database stored in the memory of the processor 134, to thereby associate each category of stone with the characteristics of the stone defined by the criteria. Optionally, multiple criteria may be used in selected ratios to create blends of stones that are deposited in any particular bin 170.

Each category of stone in the database is then associated with a particular bin 170. If the time that elapses from the point that a falling stone is detected by the synchronizer sensor 144 until a gate 166 should be opened to divert the stone to a particular distribution hose 164 and bin 170 is not known, then that elapsed time is calculated or otherwise determined, and associated in the database of the processor 134 with the bin 170.

Stones are then manually identified that meet the predefined criteria and other stones are identified that do not meet the predefined criteria. By way of example, if stones are desired that complement a particular color of brick used on a house, then stones may be identified having color that closely resembles the house brick, and other stones may be identified having color that does not closely resemble the house brick. The stones are then dropped over the edge 212 of the feeder 108 to determine whether the sensor 132 and processor 134 can discriminate between the stones that do meet specified criteria and the stones that do not meet specified criteria, and to determine whether the diverter gates 166 open and close properly, that is, whether the respective solenoids 410 are activated to open their respective gates as late as possible, and are deactivated to close their respective gates after as short a prescribed period of time as possible (e.g., 50 millisecond), with reasonable tolerance, while ensuring that each stone is correctly directed to the bin 170 designated for stones of such specified criteria. If the stones are not properly discriminated, then the sensor 132 and database values stored in the memory of the processor 134 are adjusted accordingly. If the timing of opening and closing the diverter gates 166 is not optimized so that the gates are opened for as short a period of time as possible for diverting a stone to a designated bin 170, then the timing is adjusted accordingly. The steps of adjusting, dropping the manually identified stones over the edge 212 of the feeder 108, determining whether the sensor 132 and processor 134 properly discriminate the stones, and determining whether the opening and closing of each gate 166 is optimally timed, is repeated until the stones are directed to proper bins 170.

After criteria and category data are associated in the database of the processor 134 with a corresponding bin 170, gate 166, and timing values, gravel 104 is loaded into the bin 102 and is gravity-fed to the feeder 108 and away from the bin 102 at a rate selectably controlled by the flow regulator gate 110 and facilitated by the vibrating pan 112. The gravel 104 may then, optionally, be sprayed with selected fluid by the sprayer 120, as discussed above, and directed, preferably via the posts 214, into one of the channels 210, through which one stone at a time of gravel 104 passes over the edge 212 toward a drop tube 162 of the manifold tree 160. As each stone of gravel 104 descends, the synchronizer sensor 144 detects the point in time when a respective stone breaks, or "trips", the beam of light generated by the illumination source 142, and substantially simultaneously generates a signal to the processor 134 indicative of same. Upon receipt of the signal from the synchronizer sensor 144, the processor 134 records the trip time and generates a signal to the sensor 132 to determine from illumination reflected and/or angle of refraction from the illumination source 130 a numerical representation of same. For example, if criteria is based on color reflected, then the sensor 132 may generate a number from 1 to 256 indicative of the intensity of each of the three primary colors of light, and return the numbers to the processor 134. Based on the numerical values received from the sensor 132, the processor 134 then determines whether the stone meets pre-defined criteria for any categories of stone entered into the processor 134. If it is determined that the stone meets pre-defined criteria for a category of stone, then the category of stone is stored in the processor 134.

The processor 134 then determines whether the category into which the stone was placed constitutes a category of a blend of stones. If it is determined that the category does not constitute a category of a blend, then the processor 134 generates a signal to the solenoid controller 150 directing that it activate, at a prescribed time for a prescribed period of time, a solenoid 410 to open a gate 166 to divert the stone to a particular bin 170. If it is determined that the category does constitute a category of a blend, then the processor 134 determines whether the category of stone is needed, or will predictably be needed, to create the desired blend, and then the processor 134 generates a signal to the solenoid controller 150 directing it to activate, at a prescribed time for a prescribed period of time, a solenoid 410 to open a proper gate 166 to divert the stone to a particular bin 170 where the blend is being created. If the stone is not associated with a category, then no further action is taken, and the stone is allowed enter the bin 172.

Figure 5:
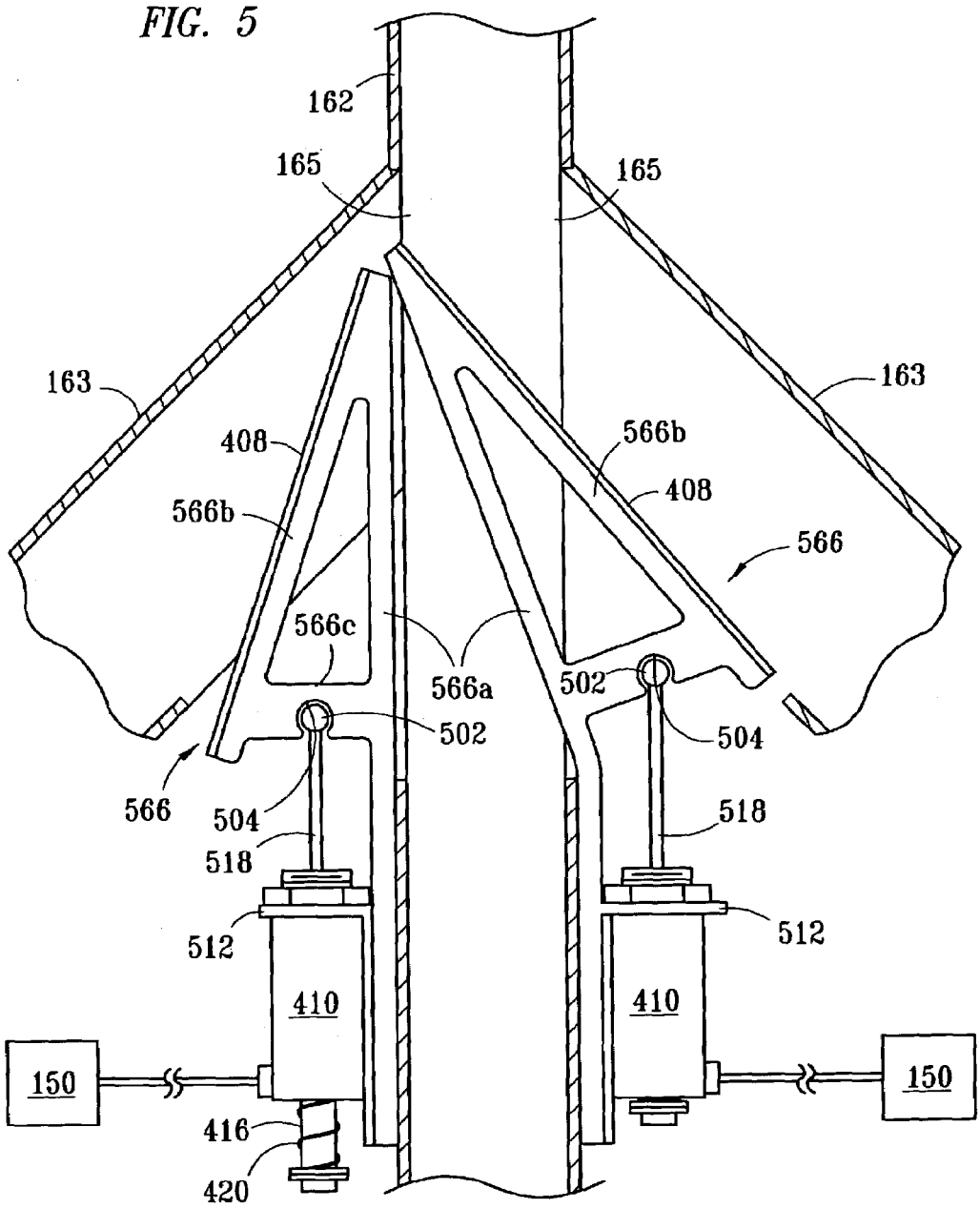
FIGS. 5 and 6 are elevation, cross-sectional views of a portion of a manifold tree showing an alternate embodiment of the two diverter gates of FIG. 4.

The embodiment of FIG. 5 is similar to the embodiment of FIG. 4, and identical components are given the same reference numerals. According to the embodiment of FIG. 5, a diverter gate assembly 566 is fabricated from a flexible material, such as plastic, and integrates the gate 166, hinge 406, and support bracket 412 of FIG. 4 into a single unit. The rod 418 is provided with a ball 502, and a horizontal portion 566*c* of the gate assembly 566 includes a socket 504, configured for receiving the ball 502. It may be appreciated that the ball 502 and socket 504 obviate the need for the linkage 414 and simplify the fabrication and maintenance of the gate assembly 566. Otherwise, the embodiment of FIG. 5 is identical to that of FIG. 4, and operation of the system 100 is unchanged from that described above with respect to FIGS. 1–4.

Figure 6:
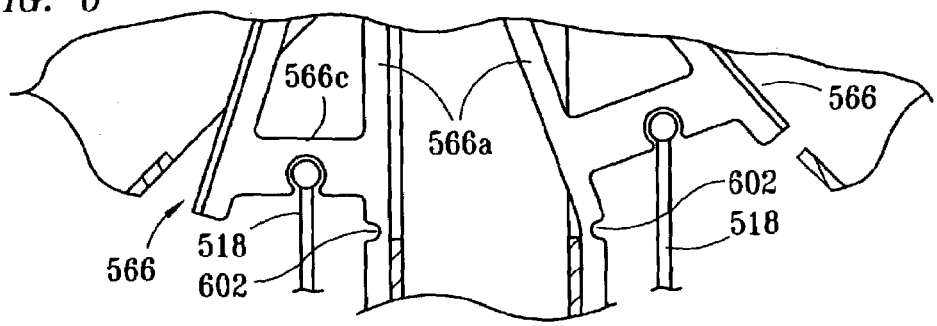

The embodiment of FIG. 6 is similar to the embodiment of FIG. 5, and identical components are given the same reference numerals. According to the embodiment of FIG. 6, a recess 602 is formed at the pivot point of the diverter gate assembly 566 for facilitating flexing of the gate assembly 566 when the gate assembly is opened to divert stones to the manifold 163. Otherwise, the embodiment of FIG. 6 is identical to that of FIG. 5, and operation of the system 100 is unchanged from that described above with respect to FIGS. 1–4.

Figure 7:
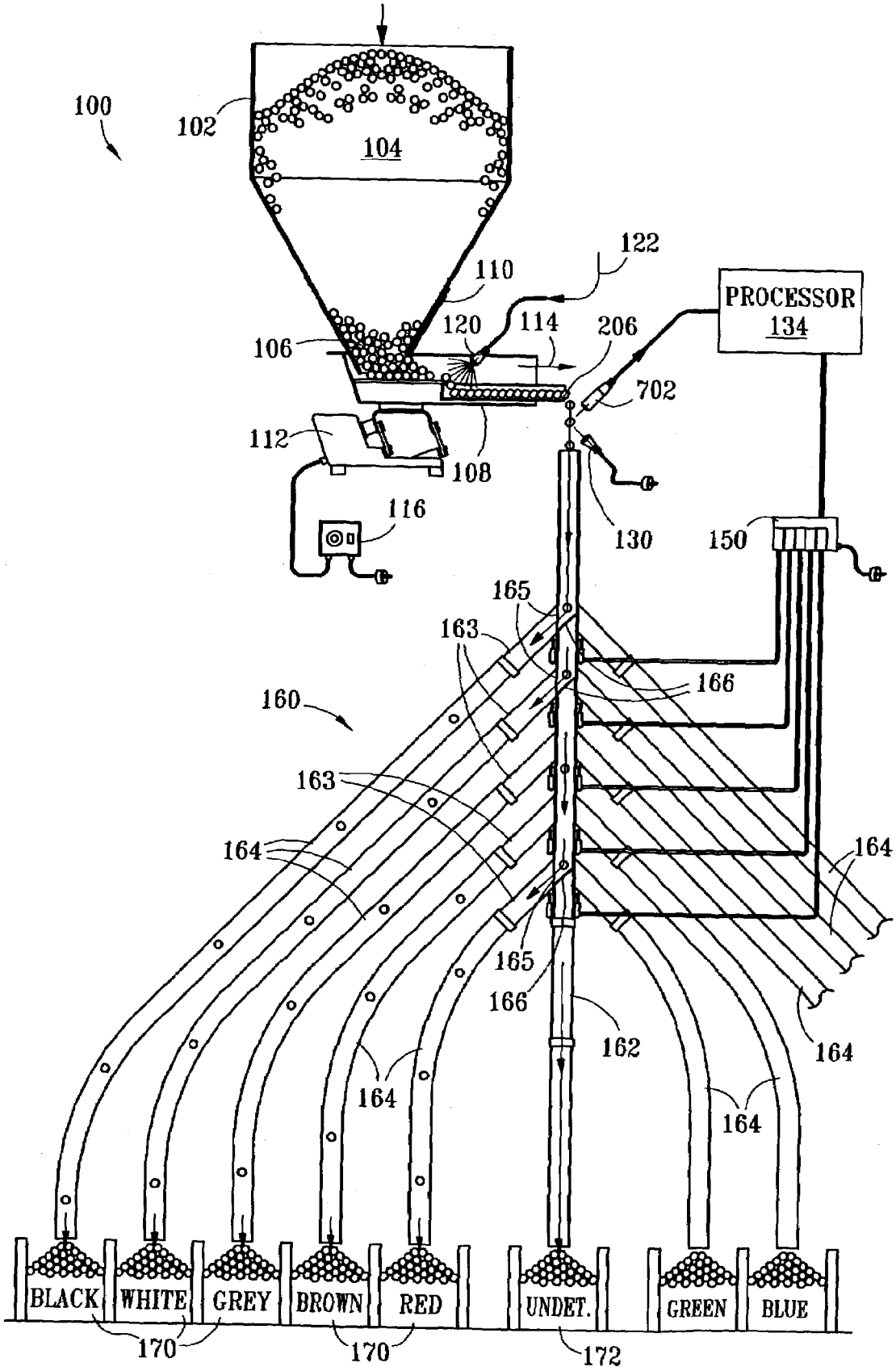
FIG. 7 is an elevation, schematic view of an alternate embodiment of a gravel separation system embodying features of the present invention.

The embodiment of the system of FIG. 7 is similar to the embodiment of the system of FIG. 1, and identical components are given the same reference numerals. However, according to the embodiment of FIG. 7, the sensor 132 is used to determine the time at which a stone passes through a particular point in space, and to synchronize timing for opening a gate 166 or 566, thereby obviating the need for the synchronizer 140, illumination source 142, and a synchronizer sensor 144. Otherwise, the embodiment of FIG. 7 and operation thereof is substantially similar to that described above with respect to FIG. 1.

By the use of the present invention, large quantities of objects, such as stones, of any size may be quickly and efficiently separated into any number of categories using virtually any of a number of different criteria, such as color, mineralogy, shape, surface texture, opacity, radioactivity, reflectivity, angle of refraction, and the like, and combinations thereof, which criteria may be programmably controlled. Different categories of stones may also be automatically and accurately blended together. The present invention also virtually eliminates the need for manual labor and, as a further result, results in much more consistent separation of objects than is possible using manual labor.

It is understood that the present invention may take many forms and embodiments. Accordingly, several variations may be made in the foregoing without departing from the spirit or the scope of the invention. For example, it is not necessary that the manifolds 163 be connected to the drop tube 162; rather, the manifolds 163 may be set apart from the drop tube 162 so that the drop tube 162, along with the diverter gates 166 or 566 and solenoids 410, may be removed for repair, maintenance, or replacement without disturbing the manifolds or continued operation of the remaining drop tubes.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A method for separating objects, comprising, for each object, the steps of:

dropping the object through a predefined path;

determining when the object passes through a predefined point in the predefined path;

spraying the object with a fluid selected for enhancing the ability to detect selected characteristics of the object;

determining selected characteristics of the object;

determining whether the characteristics of the object match at least one of at least a first criteria and a second criteria;

upon a determination that the characteristics of the object match at least the first criteria, activating a first diverter gate to divert the object from the predefined path to a first bin;

upon a determination that the characteristics of the object match at least the second criteria, activating a second diverter gate to divert the object from the predefined path to a second bin; and upon a determination that the characteristics of the object do not match at least one of at least a first criteria and a second criteria, permitting the object to follow the predefined path to a third bin.

2. The method of claim 1, wherein the characteristics comprise color.

3. The method of claim 1, wherein the object is a stone.

4. The method of claim 1, wherein the step of determining when the object passes through a predefined point further comprises determining when the object interrupts a beam of light.

5. The method of claim 1, wherein the step of determining selected characteristics of the object further comprises the step of generating an image of the object and analyzing the image to determine the selected characteristics.

6. The method of claim 1, wherein the steps of determining when the object passes through a predefined point and determining selected characteristics of the object further comprise the steps of generating an image of the object, analyzing the image to determine the selected characteristics, and recording the time that the image was captured.

7. The method of claim 1, wherein the path is predefined by a drop tube.

8. The method of claim 1, wherein the path is predefined by a substantially vertical drop tube.

9. The method of claim 1, wherein the step of dropping the object through a predefined path further comprises the steps of feeding the object with a plurality of other objects through a feeder having multiple channels, and positioning posts on the feeder for facilitating a substantially even and continuous distribution of objects to be dropped.

10. The method of claim 1, wherein at least one of at least the first criteria and the second criteria comprise continuous ranges of selected characteristics for grouping together substantially similar objects.

11. The method of claim 1, wherein at least one of at least the first criteria and the second criteria comprise discontinuous ranges of selected characteristics for creating customized blends of objects.

12. A system for separating objects, comprising:

a feeder for supplying objects to be separated and dropped through a predefined path in the system;

a data processor adapted for receiving data and executing program code with respect to the data;

a sprayer for spraying the objects with a fluid selected for enhancing the ability to determine selected characteristics of the object;

a sensor, positioned proximate to the feeder, for determining when the object passes through a predefined point in the predefined path, and for determining selected characteristics of the object, the sensor being connected to the data processor for transmitting thereto the time when the object passes through a predefined point and the selected characteristics of the object;

program code executable by the processor for determining whether the characteristics of the object match at least one of at least a first criteria and a second criteria;

at least a first diverter gate operatively connected to the data processor for diverting, upon a determination that the characteristics of the object match the first criteria, the object from the predefined path to at least a first bin;

at least a second diverter gate operatively connected to the data processor for diverting, upon a determination that the characteristics of the object match the second criteria, the object from the predefined path to at least a second bin; and at least a third bin positioned for receiving objects that are not diverted into at least the first bin or the second bin.

13. The system of claim 12, wherein the characteristics comprise color.

14. The system of claim 12, wherein the object is a stone.

15. The system of claim 12, wherein the sensor for determining when the object passes through a predefined point further comprises determining when the object interrupts a beam of light.

16. The system of claim 12, wherein the sensor for determining selected characteristics of the object is configured for generating an image of the object and analyzing the image to determine the selected characteristics.

17. The system of claim 12, wherein the sensor for determining when the object passes through a predefined point and for determining selected characteristics of the object is configured for generating an image of the object, analyzing the image to determine the selected characteristics, and recording the time that the image was captured.

18. The system of claim 12, wherein the path is predefined by a drop tube.

19. The system of claim 12, wherein the path is predefined by a substantially vertical drop tube.

20. The system of claim 12, wherein the feeder includes multiple channels, and posts positioned on the feeder for facilitating a substantially even and continuous distribution of objects to be dropped.

21. The system of claim 12, wherein at least one of at least the first criteria and the second criteria comprise continuous ranges of selected characteristics for grouping together substantially similar objects.

22. The system of claim 12, wherein at least one of at least the first criteria and the second criteria comprise discontinuous ranges of selected characteristics for creating customized blends of objects.

* * * * *